United States Patent [19]

Nakanishi

[11] Patent Number: 4,948,131

[45] Date of Patent: Aug. 14, 1990

[54] VIBRATION DAMPENING RACKET

[75] Inventor: Motoyasu Nakanishi, Fujishi, Japan

[73] Assignee: Kabushiki Kaisha Sigel, Tokyo, Japan

[21] Appl. No.: 354,460

[22] Filed: May 15, 1989

[30] Foreign Application Priority Data

May 14, 1988 [JP] Japan ..... 63-117980

[51] Int. Cl.[5] ..... A63B 49/00; A63B 53/14

[52] U.S. Cl. ..... 273/73 R; 273/73 G; 273/81 A; 273/DIG. 29

[58] Field of Search ..... 273/73 R, 73 S, 72 R, 273/DIG. 29, 81 A, 80.8, 73 G

[56] References Cited

U.S. PATENT DOCUMENTS

| | | |
|---|---|---|
| 3,941,380 | 3/1976 | Lacoste . |
| 4,182,512 | 1/1980 | Kuebler . |
| 4,194,738 | 3/1980 | Inoue et al. . |

FOREIGN PATENT DOCUMENTS

| | | | |
|---|---|---|---|
| 0171033 | 8/1985 | European Pat. Off. . | |
| 171033 | 6/1986 | European Pat. Off. | 273/73 R |
| 261994 | 3/1988 | European Pat. Off. | 273/73 R |
| 3521650 | 6/1986 | Fed. Rep. of Germany | 273/73 R |
| 1376724 | 11/1964 | France | 273/73 R |
| 55-58177 | 4/1980 | Japan . | |
| 62-192182 | 8/1987 | Japan . | |
| 62-192183 | 8/1987 | Japan . | |

*Primary Examiner*—Edward M. Coven
*Assistant Examiner*—Valerie Szczepanik
*Attorney, Agent, or Firm*—Wenderoth, Lind & Ponack

[57] ABSTRACT

A racket for playing tennis or similar ball games having a straight bar type stem part which continues to an annular ball hitting part. A hole is provided in the stem part in which a vibration absorbing member is stored. Said vibration absorbing member comprises a buffer layer made of a gel material and a mass member supported by this buffer layer. The buffer layer is fixed so that it can be deformed in said hole and said mass member is supported so that it does not contact the internal surface of the hole. Said vibration absorbing member can be put in an outer casing and inserted into the hole. In this case, the buffer layer is deformed in the outer casing and the mass member is held so that it does not contact the internal surface of the outer casing.

25 Claims, 6 Drawing Sheets

VIBRATION DAMPENING RACKET

BACKGROUND OF THE INVENTION

The present invention relates to the racket which absorbs a shock or impact produced on the ball hitting net surface by the vibration absorbing member such as, for example, tennis rackets, squash rackets or the like.

This kind of conventional vibration absorbing type racket has the frame in which the buffer layer made of a gel material with the penetration value of approximately 50 to 200, such as silicone gel, is contained as a vibration absorbing means.

This type of racket is disclosed in the U.S. Pat. Application Ser. No. 161130 dated Feb. 26, 1988 and the U.S. Pat. Application Ser. No. 231211 dated Aug. 11, 1988.

In case of the racket as described above, a shock produced on the ball hitting net when a ball is hit is applied as a vibration wave to the buffer layer made of a gel material to deform said buffer layer and is thus damped. For this reason, this type of racket accompanies a problem that the shock absorbing effect will be deteriorated if the energy of shock is large.

The other kind of vibration absorbing type racket is such that the frame is provided with the mass member which is transformed by a shock energy produced on the ball hitting net and the vibration wave is thus dissipated. This type of racket is disclosed in the U.S. Pat. No. 4182512.

In case of this type of racket, a new vibration wave is often produced by a movement of the mass member and there is a problem in the vibration absorbing characteristics.

In recent years, therefore, a racket using a composite vibration absorbing member which comprises a combination of a mass member and a tacky elastic member has been offered as disclosed in the Japanese Patent Gazettes Kokai SHO 62-192182 and Kokai SHO 62-192183.

This type of racket is adapted to absorb the vibration wave by a movement of the mass member and a low repulsive deformation of a tacky elastic member and can therefore provide the satisfactory vibration absorbing characteristics.

However, the conventional composite vibration absorbing member as described above is stored in the grip part of the racket frame and the assembling and replacing works will be troublesome.

SUMMARY OF THE INVENTION

An object of the present invention is to provide the racket in which the vibration absorbing member comprising the mass member and the buffer layer made of a gel material can be easily fitted.

For this purpose, the racket in accordance with the present invention is provided with a hole in the straight bar part between the ball hitting part and the grip part to store therein the vibration absorbing member. Another object of the present invention is to provide the racket allowing easy replacement of said vibration absorbing member.

For this purpose, in the racket in accordance with the present invention, said vibration absorbing member is encapsulated in the outer cylindrical case and this encapsulated vibration absorbing member is removably inserted and secured in the hole of the frame.

Another further object of the present invention is to obtain a satisfactory design appearance by storing said vibration absorbing member in the hole of the frame.

For this purpose, the opening end of said hole is closed with a decoratively designed cover and this cover is made of, for example, a convex lens and an end of the vibration absorbing member which can be seen through the convex lens is, for example, colored or engraved with the initials to ensure the design effect of the cover.

DETAILED DESCRIPTION OF PREFERRED EMBODIMENT

Figure 1:
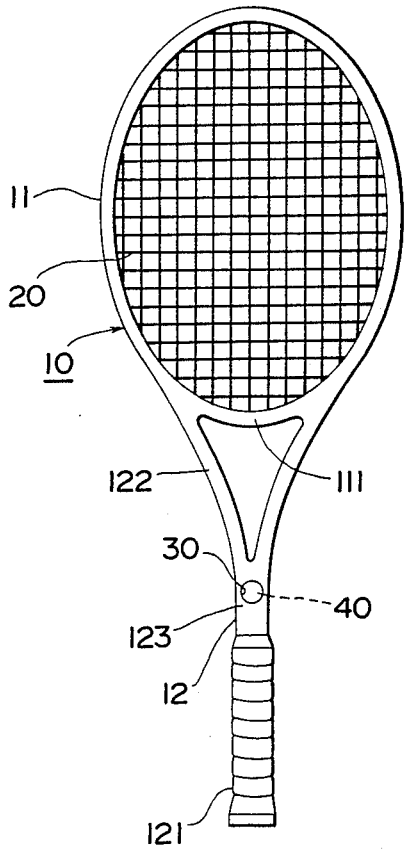
FIG. 1 is a front view of the racket in accordance with the present invention.
Figure 2:
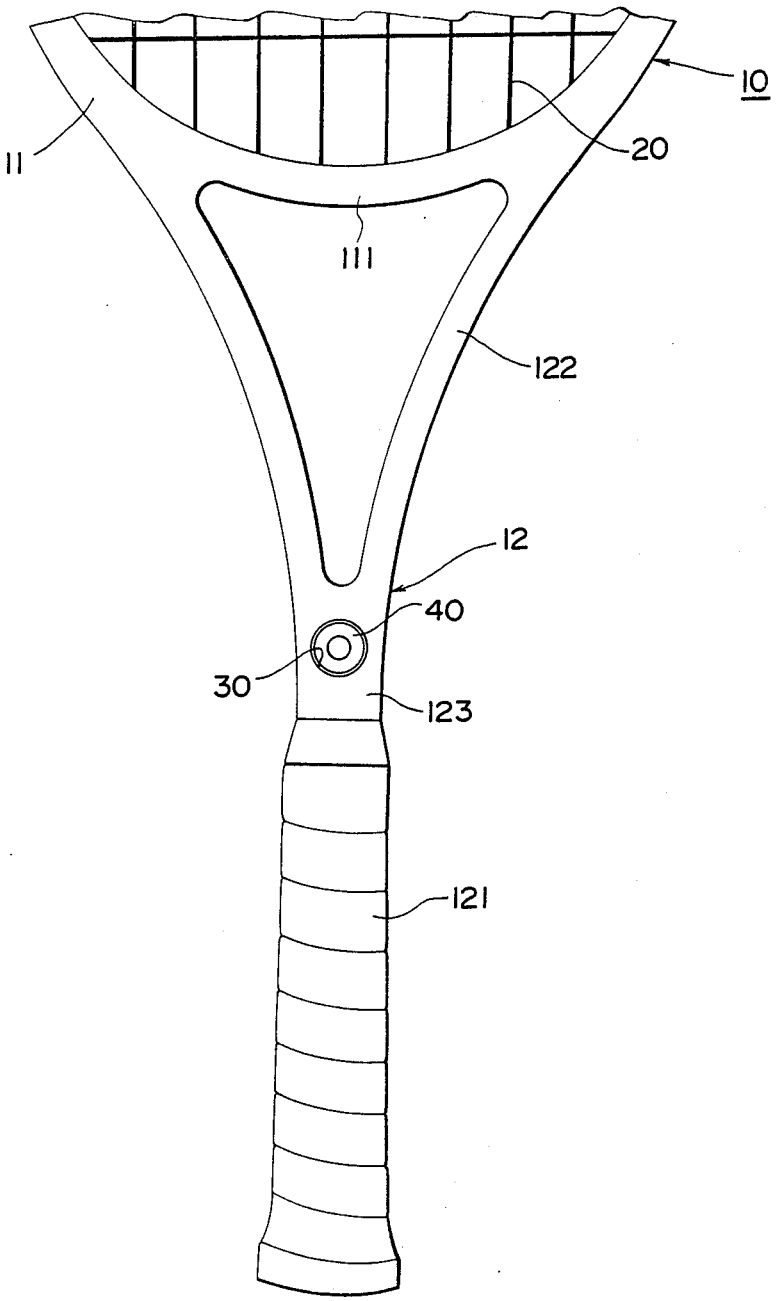
FIG. 2 is a magnified front view of the principal part of the racket shown in FIG. 1.

Referring to FIGS. 1 to 4, there is shown the tennis racket as the first embodiment of the racket in accordance with the present invention.

In this embodiment, the frame 10 formed by bending a single hard skeleton member has the ball hitting part 11 which is made in an annular form and the bar type stem part 12 which follows the ball hitting part, and the grip part 121 is formed on the free end side of the stem part 12.

The netting 20 is formed on the ball hitting part 11 of said frame 10 and used as the ball hitting net 20.

In the embodiment, said frame 10 is integrally formed with a shaft member made of a glass fiber reinforced plastic material having a core member of foamed synthetic resin. For this reason, the part continuing to said ball hitting part 11 of said stem part 12 is formed as a forked coupling part 122 and this coupling part is provided so that the traverse frame member 111 forms the lower part of said ball hitting part 11.

For making said frame 10 as in the embodiment, there are available a method that the prepeg which is a molded glass fiber reinforced plastic material is wound around the core member which is bent and formed in advance into a frame and this prepeg-wound core member is heated under a pressure to be finally molded in the mold or a method that the prepeg is wound around the core member to make a bar type shaft member and this shaft member is fitted into the mold while bending it and heated under a pressure to be molded.

For the stem part 12 of said frame, the straight bar part 123 between the coupling part 122 and the grip part 121 is provided with the hole 30 which is formed in the straight bar part 123 at right angles to the lengthwise direction of the stem part 12.

Although said hole 30 can be a through hole which passes through the straight bar part 123, it can be made as a blind hole having a bottom.

The vibration absorbing member 40 is sealed in said hole 30 and this vibration absorbing member 40 has the mass member 41 and the buffer layer 42.

Said mass member 41 can be optionally selected if it has the specified weight. However, it is desirable that the weight of the mass member 41 is heavy in spite of its small volume and therefore lead is generally used and this lead is coated with a synthetic resin.

Said buffer layer 42 is made of a gel material and supports said mass member 41 while an area such as, for example, a space where said buffer layer is deformable is provided. Said buffer layer 42 supports the mass member 41 so that said mass member 41 does not come in contact with the internal surface of the hole 30 and accordingly the mass member 41 is displaced while deforming only the buffer layer 42 when a shock is applied.

Said hole 30 can be formed by drilling a hole in the stem part 12 after the frame 10 has been formed. In the embodiment, since the hole is simultaneously formed when the shaft member is formed by heating under a pressure during bending of the shaft member, the hole wall 31 is made with a synthetic resin.

Said hole 30 is provided with the cover 32 at its opening side by which the vibration absorbing member 40 is sealed in the hole.

It is preferable that said cover 32 is attached to be refittable and, in the embodiment, therefore the cover 32 is screwed to the opening portion of the hole 30. Said hole 30 can be open at its both ends and, in this case, the cover 32 is fitted to both opening ends, respectively.

Said vibration absorbing member 40 is made in a construction that the mass member 41 is sealed in a cylindrical buffer layer 42 and the buffer layer 42 is partly cut away at both sides in the axial direction so that said buffer layer 42 can be deformed. Said buffer layer 42 is covered with the external covering layer 421 and this external covering layer 421 is fixed to the hole wall 31 with an adhesive agent or the like.

In this case, said buffer layer 42 can be directly adhered to the hole wall 31 without forming an external covering layer 421 and can be formed by pouring the original liquid for gel material into the hole 30 of the racket which is placed so that said hole 30 is faced up and gelling this original liquid.

Also in this case, the space which allows deformation of the buffer layer 42 can be formed by setting in advance a jig in the hole 30 or partly cutting off the gel material from the opening end of the hole 30 after said original liquid has been gelled.

As the gel material for forming said buffer layer 42, it is preferable to use the silicone gel which has the penetration value of approximately 50 to 200 measured according to JIS K2530-1976 (50g load). Such gel material includes Toray Silicone CF5027 (trade name) manufactured by Toray Silicone Kabushiki Kaisha and KE-1051(product name) manufactured by Shin Etsu Kagaku Kogyo Kabushiki Kaisha. It is most desirable to use, as said gel material, a composite silicone gel material as disclosed in the U.S. Pat. Application Ser. No. 87970 filed on Aug. 17, 1987 and this composite silicone gel material is made up by mixing fine hollow particles of 1 to 4 weight % such as Fillite (registered trademark) manufactured by Nippon Fillite Kabushiki Kaisha or Expancel (registered trademark) sold by the same company in the gel material having the penetration value of approximately 50 to 200 and this gel material excels particularly in the buffer effect.

In addition, said composite silicone gel material also includes a type of gel material made up by mixing fine silica powder in silicone gel having the penetration value of approximately 50 to 200. Since this silicone gel material has a characteristic of high tear strength, it can provide a larger effect in actual use if the weight of the mass member 41 is large and can ensure excellent adhesive effect of an adhesive agent to said buffer layer since the tackiness of the surface of the buffer layer employing this silicone gel material is small.

In the above embodiment, an impact wave produced on the net 20 is conducted to the frame 10 and absorbed by the vibration absorbing member 40 in the stem part 12.

In other words, the energy of said impact wave is dissipated and damped to displace the mass member 41 of the vibration absorbing member 40 and the kinetic energy of the mass member 41 is absorbed by a low elastic deformation, that is, a substantial non-elastic distortion of the buffer layer 42.

Since the gel material has a conductive characteristic similar to a liquid, the impact wave which has displaced the mass member 41 is quickly dispersed throughout the buffer layer 42 and absorbed by the buffer layer 42 only with slight vibration waves owing to small repulsive elasticity. If the gel material is mixed with fine hollw particles 401, the weight of the buffer layer 42 can be reduced and also the buffer effect can be improved.

In the above embodiment, the vibration absorbing member 40 is directly sealed in the hole 30 and the mass member 41 of the vibration absorbing member 40 is supported by the buffer layer 42 so that said mass member 41 does not come in contact with the internal surface of the hole which is formed by the hole wall 31 and the internal surface of the cover 32.

However, in case of the construction as described above, it is difficult to replace the vibration absorbing member 40 and therefore to select, for example, the mass member 41.

Figures 5, 6:
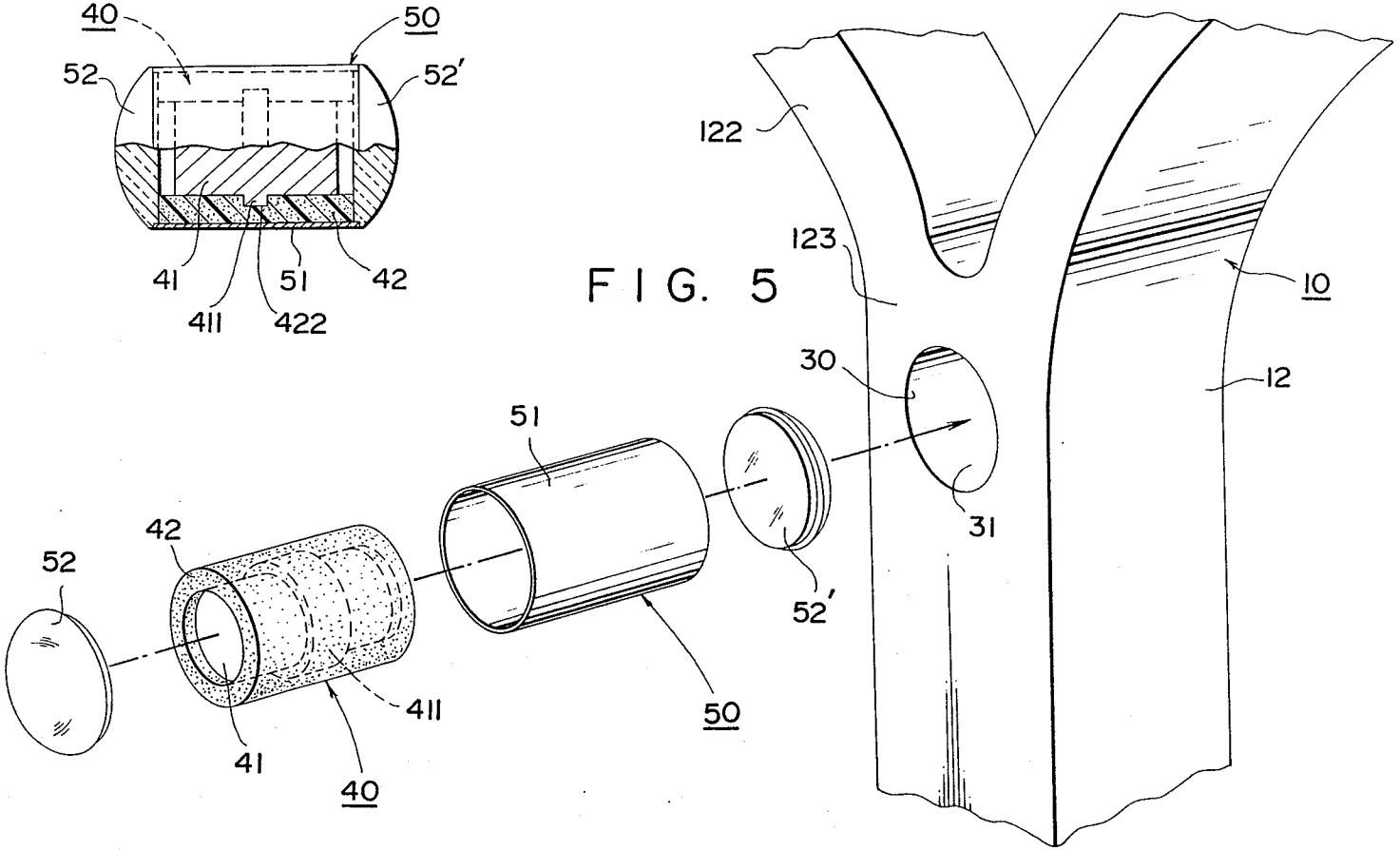
FIG. 5 is a perspective view of the principal part showing another embodiment of the racket in accordance with the present invention.
FIG. 6 is a partly cutaway side view of the vibration absorbing member shown in FIG. 5.

Referring to FIGS. 5 and 6, there is shown the vibration absorbing member 40 sealed in the outer casing such as, for example, the outer cylindrical case 50.

In the embodiments described in the following description, the same parts as in the above embodiment are given the same numbers as in the above embodiment to avoid duplication of the detailed description.

In this embodiment, the outer cylindrical case 50 comprises the barrel part 51 which accommodates the vibration absorbing member 40 and covers 52 and 52' provided at the opening parts at both ends of this barrel part 51, and the buffer layer 42 of said vibration absorbing member 40 is fixed to be deformable inside the barrel part 51 and the mass member 41 is supported to be displaceable by this buffer layer 42.

Said barrel part 51 can be open only at one end and, in this case, the cover 52 is attached to only one end of the barrel part 51. Said outer cylindrical case 50 is fixed in the hole 30. In this embodiment, the barrel part 51 of the outer cylindrical case 50 is adhered with an adhesive agent to the hole wall 31 of the hole 30 but, as described below, this outer cylindrical case 50 can be remountably set in the hole 30.

Said mass member 41 is provided with the engaging projection 411 at its external surface and fixed by engaging this engaging projection 411 with the engaging recess 422 of the buffer layer 42. The external surface of this mass member 41 can further be adhered to the buffer layer 42 with the adhesive agent.

Said covers 52 and 52' can be a plate cover but, in this embodiment, the covers are respectively made as a convex lens (or a concave lens). If the lens is thus used as the cover, it can provide an artistic design of appearance and permit a magnified observation of the end face of the mass member 41 contained. Accordingly, the factor of the artistic design of the racket can be further increased by, for example, entering the user's initials on the end face of the mass member 41 or coloring the end face of the vibration absorbing member 40 to give the appearance of more artistic design to the racket.

Figure 7:
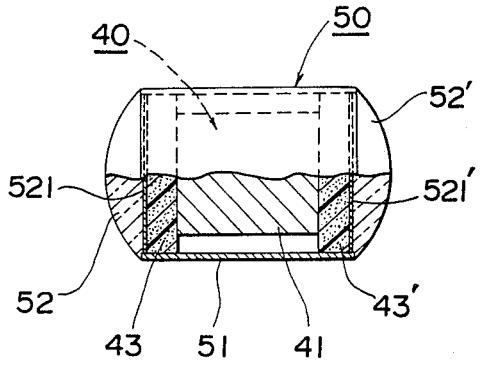
FIGS. 7 and 8 are respectively a partly cutaway side view showing another embodiment of said vibration absorbing member.

Referring to FIG. 7, the mass member 41 of the vibration absorbing member 40 as shown is supported at its both end faces by a pair of wall type buffer layers 43 and 43' and surrounded by a space formed on the external periphery of the mass member 41.

Lustered surfaces 521 and 521' obtained by evaporating aluminum are formed on the internal surfaces of said covers 52 and 52' and these lustered surfaces can be observed through transparent covers 52 and 52' from outside.

Figure 8:
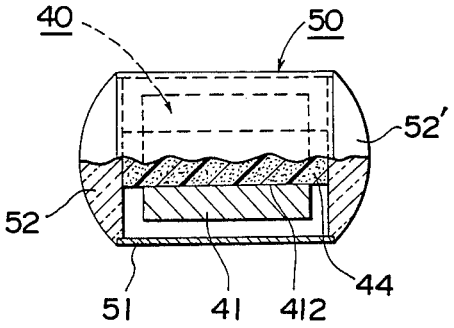

Referring to FIG. 8, the mass member 41 of the vibration absorbing member 40 as shown has the through hole 412 in the axial direction and supported by the column type buffer layer 44 made of a gel material which passes through this through hole 412.

Said column type buffer layer 44 is fixed by adhering both ends of this buffer layer to the internal surfaces of covers 52 and 52'.

In this embodiment, accordingly, it is difficult to take out the vibration absorbing member after it has been built in the outer cylindrical case 50.

Figure 9:
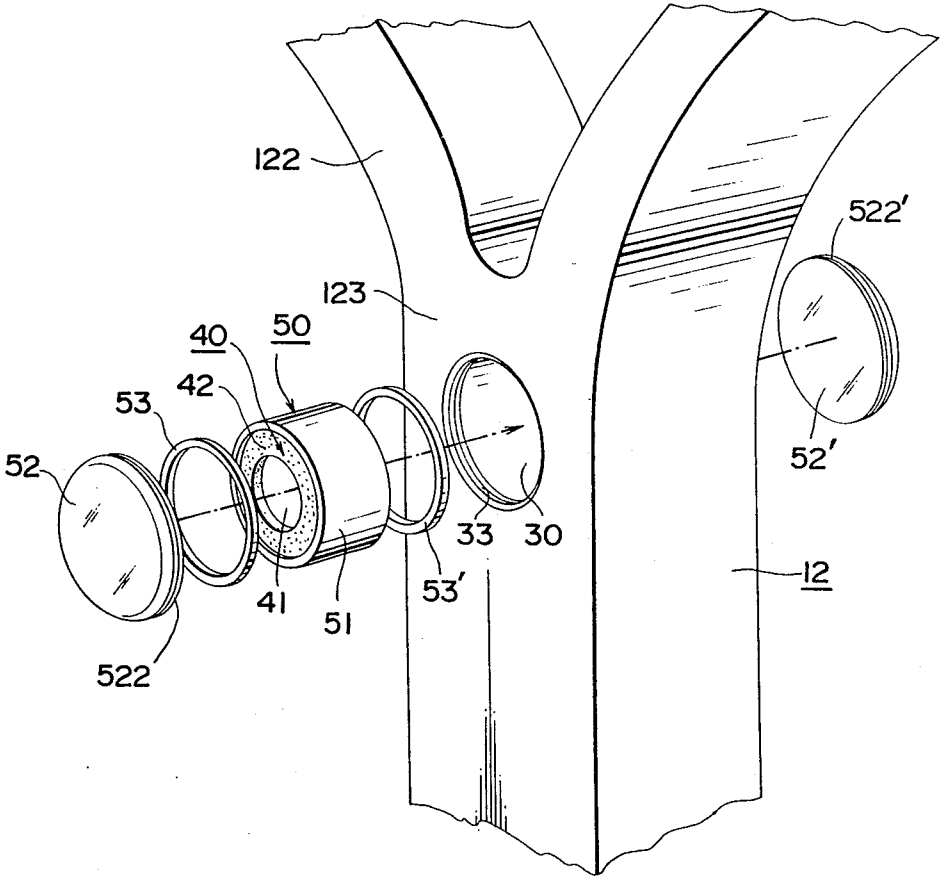
FIG. 9 is a disassembled perspective view of the principal part showing another embodiment of the racket in accordance with the present invention.
Figure 10:
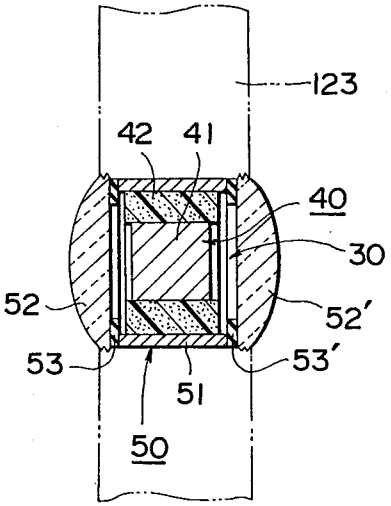
FIG. 10 is a vertical cross sectional side view of the vibration absorbing member shown in FIG. 9.

Referring to FIGS. 9 and 10, in the embodiment as shown, the outer cylindrical case 50 containing the vibration absorbing member 40 is remountably inserted into the hole 30.

In this embodiment, the internal threads 33 are provided respectively at the opening ends of the hole 30 and said covers 52 and 52' are thread-fitted to these internal threads 33. For the above purpose, covers 52 and 52' are respectively provided with external threads 522 and 522' at their external peripheries and 0 rings 53 and 53' are respectively mounted between covers 52 and 52' and the barrel part 51 to hold the barrel part 51 between covers 52 and 52'.

In this embodiment, the barrel part 51 inserted into the hole can be taken out from the hole 30 by removing at least one of covers 52 and 52' and replacement of the vibration absorbing member 40 can therefore be easy.

Figure 11:
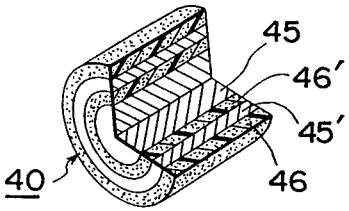
FIG. 11 is a partly cutaway perspective view showing another further embodiment of the vibration absorbing member for use in the racket in accordance with the present invention.

Referring to FIG. 11, there is shown another embodiment of said vibration absorbing member 40.

This vibration absorbing member 40 is constructed by alternately stacking a plurality of mass members 45 and 45' and a plurality of buffer layers 46 and 46' and the outermost layer of this stacking type vibration absorbing member 40 is made as the buffer layer 46.

In this embodiment, since mass members 45 and 45' are coupled with the buffer layer 46', the resonance frequency band exists at a plural number of locations and a certain range of allowance can be given for variations of the natural frequency of a racket user.

Figure 3:
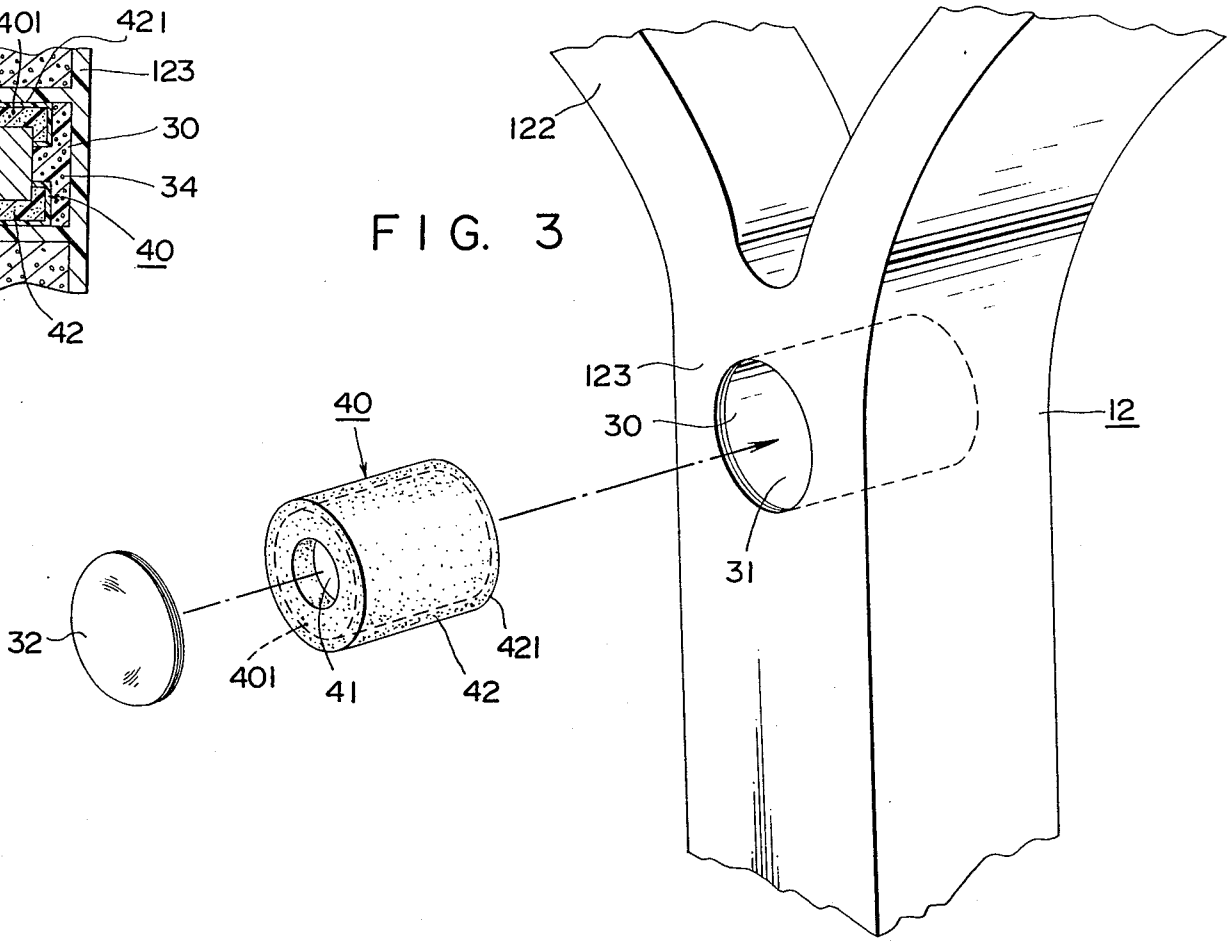
FIG. 3 is a further magnified perspective view of the disassembled principal part of said racket.
Figure 4:
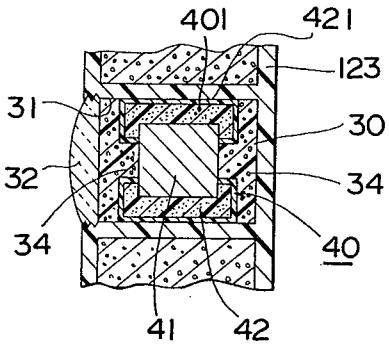
FIG. 4 is a vertical cross sectional side view of the principal part of the racket shown in FIG. 3.

In the above description, though the hole 30 formed in the frame 10 is shown as a circular form, it can have another polygonal form such as, for example, triangle and hexagon and the vibration absorbing member 40 shown in the embodiment can comprise the mass members and the buffer layers in other types of shapes. Said hole 30 or said outer cylindrical case 50 need not always have a hollow space if the buffer layer 42 can be deformed inside the hole 30 and the outer cylindrical case 50. For example, the inside space can be filled with a soft foamed layer 34 as shown in FIG. 3.

The racket in accordance with the present invention is not limited to said embodiments and can be modified or changed within the scope of claims of the present application.

What is claimed is:

1. A racket for playing tennis or similar ball games comprising (a) a frame which has an annular ball hitting part and a bar type stem part having two ends, one end attached to said ball hitting part and the other end having a grip part thereon, (b) a net which is extended across said ball hitting part, (c) a hole which is provided on a straight bar part between said grip part and said ball hitting part of the stem part of said frame and which is open at least at its one end, (d) at least one cover which is attached to the opening of said hole, and (e) a vibration absorbing member which is accommodated in said hole, wherein said vibration absorbing member comprises at least one buffer layer of a gel material which is fixed to be deformable in said hole, and at least one mass member for weighing said racket which is supported by said buffer layer so that said mass member does not come in contact with the internal surfaces of said hole and cover.

2. A racket in accordance with claim 1, wherein said buffer layer is made of a silicone gel material.

3. A racket in accordance with claim 2, wherein said silicone gel material is a silicone gel having a penetration value of approximately 50 to 200.

4. A racket in accordance with claim 2, wherein said silicone gel material is made up by mixing 1 to 4 weight percent of fine hollow particles in a silicone gel having a penetration value of approximately 50 to 200.

5. A racket in accordance with claim 1, wherein said vibration absorbing member comprises a round columnar mass member stored in a cylindrical buffer layer.

6. A racket in accordance with claim 5, wherein an engaging projection is provided on said mass member and engaged with an engaging recess provided on the internal surface of said buffer layer.

7. A racket in accordance with claim 1, wherein said mass member is supported by a pair of wall type buffer layers respectively coupled to both ends of the mass member.

8. A racket in accordance with claim 1, wherein said mass member has a through hole provided in its axial direction and said buffer layer passes through said through hole.

9. A racket in accordance with claim 1, wherein said vibration absorbing member has a plurality of mass members and a plurality of buffer layers, said mass members and said buffer layers are alternately stacked and an external surface of said vibration absorbing member is formed by the buffer layer.

10. A racket in accordance with claim 1, wherein said cover attached to said hole is a lens.

11. A racket in accordance with claim 10, wherein said cover is made with a concave lens and at least one end face of said vibration absorbing member opposed to the internal side of said convex lens is given an artistic design of appearance.

12. A racket for playing tennis or similar ball games comprising (a) a frame which has an annular ball hitting part and a bar type stem part having two ends, one end attached to said ball hitting part and the other end having with a grip part thereon, (b) a net which is extended across said ball hitting part, (c) a hole which is provided on a straight bar part between said grip part and said, ball hitting part of the stem part of said frame and which is open at least at one end, (d) an outer casing which is inserted and fixed in said hole, and (e) a vibration absorbing member which is accommodated in said outer casing, wherein said vibration absorbing member comprises at least one buffer layer of a gel material which is accommodated and fixed to be deformable in said outer casing and at least one mass member for weighing said racket which is supported by said buffer layer so that said mass member does not come in contact with the internal surface of said outer casing.

13. A racket in accordance with claim 12, wherein said buffer layer is made of a silicone gel material.

14. A racket in accordance with claim 13, wherein said silicone gel material is a silicone gel having a penetration value of approximately 50 to 200.

15. A racket in accordance with claim 13, wherein said silicone gel material is made up by mixing 1 to 4 weight percent of fine hollow particles in a silicone gel having a penetration value of approximately 50 to 200.

16. A racket in accordance with claim 12, wherein said vibration absorbing member comprises a round columnar mass member is stored in a cylindrical buffer layer.

17. A racket in accordance with claim 16, wherein an engaging projection is provided on said mass member and engaged with an engaging recess provided on the internal surface of the buffer layer.

18. A racket in accordance with claim 12, wherein said mass member is supported by a pair of wall type buffer layers respectively coupled to both ends of the mass member.

19. A racket in accordance with claim 12, wherein said mass member has a through hole in its axial direction and said buffer layer passes through this through hole.

20. A racket in accordance with claim 12, wherein said vibration absorbing member has a plurality of mass members and a plurality of buffer layers which are alternately stacked and the external surface of said vibration absorbing member is formed by the buffer layer.

21. A racket in accordance with claim 12, wherein said outer casing comprises a barrel part which has an opening at least at its one side and a cover attached to said opening.

22. A racket in accordance with claim 21, wherein said cover is a lens.

23. A racket in accordance with claim 22, wherein said cover is made with a convex lens and at least one end face of said vibration absorbing member opposed to the inside of said convex lens is made to provide an artistic design in its appearance.

24. A racket in accordance with claim 21, wherein the cover of said outer casing is screwed to be freely remountable to the opening end of said hole and the barrel part of the outer casing is fixed by said screw-fitted cover in the hole.

25. A racket in accordance with claim 24, wherein an 0 ring is provided between said cover and said barrel part.

* * * * *